US005106027A

United States Patent [19]

Wirtz et al.

[11] Patent Number: 5,106,027

[45] Date of Patent: Apr. 21, 1992

[54] APPARATUS FOR PREPARING A STRAND END OF A PACKAGE OF TEXTILE MATERIAL

[75] Inventors: Ulrich Wirtz; Helmuth Hensen, both of Monchen-Gladbach, Fed. Rep. of Germany

[73] Assignee: W. Schlafhorst AG & Co., Monchen-Gladbach, Fed. Rep. of Germany

[21] Appl. No.: 563,416

[22] Filed: Aug. 6, 1990

[30] Foreign Application Priority Data

Aug. 4, 1989 [DE] Fed. Rep. of Germany ..... 3925861

[51] Int. Cl.[5] ..... B65H 54/00; B65H 65/00

[52] U.S. Cl. ..... 242/18 R; 242/18 EW; 242/35.6 DE

[58] Field of Search ..... 242/18 R, 18 EW, 35.5 R, 242/35.5 A, 35.6 R, 35.6 E

[56] References Cited

U.S. PATENT DOCUMENTS

| | | | |
|---|---|---|---|
| 2,921,752 | 1/1960 | Bourassa et al. | 242/18 EW X |
| 3,236,464 | 2/1966 | Wey . | |
| 4,634,065 | 1/1987 | Kupper et al. | 242/18 R |
| 4,681,271 | 7/1987 | Matsui et al. | 242/18 R |
| 4,848,077 | 7/1989 | Kawarabashi et al. | 242/35.6 E X |
| 4,909,451 | 3/1990 | Kuepper et al. | 242/18 EW |
| 4,911,371 | 3/1990 | Mista | 242/35.6 E |

FOREIGN PATENT DOCUMENTS

| | | |
|---|---|---|
| 1276523 | 8/1968 | Fed. Rep. of Germany . |
| 1943489 | 4/1970 | Fed. Rep. of Germany . |
| 2005362 | 8/1970 | Fed. Rep. of Germany . |
| 539576 | 9/1973 | Switzerland . |
| 1245770 | 9/1971 | United Kingdom . |

*Primary Examiner*—Stanley N. Gilreath
*Attorney, Agent, or Firm*—Shefte, Pinckney & Sawyer

[57] ABSTRACT

An apparatus for preparing an end of a strand of textile material built into a package includes a conduit for supporting the strand end during unwinding and a device for engaging the unwound strand end to apply yieldable resistance thereto in opposition to rewinding of the strand end onto the textile package. Additionally, the strand preparing apparatus preferably includes a conduit operatively connected to a suction source and having an opening, the conduit being disposed for applying suction through the opening to the package. A rewinding guide member is selectively positionable along the conduit opening for adjusting the relative position at which the unwound strand end exits the conduit during rewinding onto the package to thereby vary the predetermined axial location on the package onto which the strand end is rewound. A device for reducing the effective transverse cross-sectional area of the conduit includes a plate member disposable adjacent the opening for controlling the suction to predetermined values along the conduit opening.

11 Claims, 1 Drawing Sheet

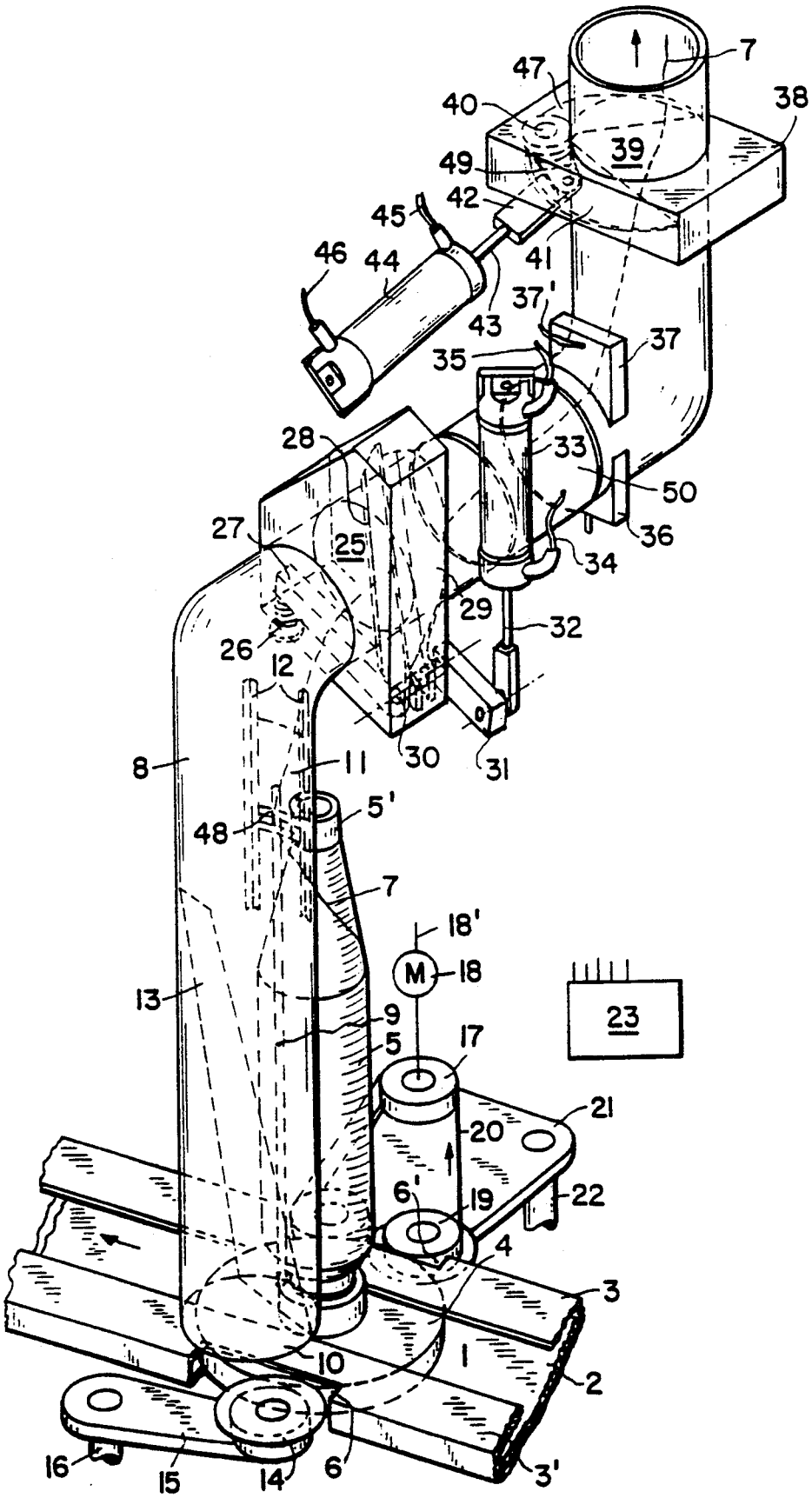
7
47
40
38
39
49
42
45
41
46
44
43
37'
37
35
28
33
50
27
25
36
34
29
32
26
12
30
31
8
11
5'
48
7
18'
M
18
13
9
23
5
17
21
20
6'
19
22
4
3
10
1
2
16
15
14
6
3'

APPARATUS FOR PREPARING A STRAND END OF A PACKAGE OF TEXTILE MATERIAL

BACKGROUND OF THE INVENTION

The present invention relates to an apparatus for preparing an end of a strand of textile material built into a package.

A primary objective of a strand or yarn end preparation process is the relatively fast, non-damaging placement of the strand or yarn end on the package in a preferred disposition for ready engagement of the strand or yarn end at a winding station of a winding machine. In U.S. Pat. No. 4,681,271, a yarn end preparation device is disclosed which includes a conduit having a slot formed therein for applying a suction to a yarn package to thereby engage a yarn end of the package and subsequently unwind the yarn end which is subsequently disposed in proper position for engagement at the winding station.

In German Auslegeschrift No. 18 06 672, a yarn end preparation device is disclosed which includes a pair of parallel rotating rollers. A yarn package to be prepared is disposed in axial alignment with the rotatable rollers with its outer surface in engagement with the rollers and the rollers are rotated to effect corresponding unwinding rotation of the yarn package. A pneumatic suction apparatus is disposed between the rotating rollers to apply suction to the rotating yarn package to thereby engage a yarn end thereof and to draw the yarn end from the yarn package. The suction apparatus includes a sensor for sensing the travel therepast of an unwound yarn end and a yarn cutting device is actuated in correspondence with the sensing of the unwound yarn end to cut the yarn end. In correspondence with the cutting of the yarn end, the yarn package is axially moved relative to the rotating rollers to position the top portion of the yarn package relative to the suction device for rewinding of the unwound yarn end onto the top portion of the package. The repositioning of the yarn package relative to the suction device is necessary because the yarn end engaged by the suction device typically enters the opening of the suction device at the same relative axial location at which the yarn end is dislodged from the outer surface of the yarn package.

However, the need exists for improvements in yarn end preparation devices of the type which unwind a yarn end from a yarn package and subsequently support the unwound yarn end while the yarn end is rewound onto the yarn package at a preferred axial location thereon. For example, in the yarn end preparation device disclosed in U.S Pat. No. 4,681,271, the conduit slot extends beyond the yarn package and this leads to a relatively high suction flow requirement as well as a less than optimum application of suction force to the yarn package. In those yarn end preparation devices of the type in which the yarn package is axially shifted to align the yarn package for rewinding of an unwound yarn end onto the package, devices capable of relatively complex movements must be provided to handle those yarn packages delivered to the yarn end preparation device which are individually supported on package support members.

Accordingly, the need exists for a yarn or strand end preparation apparatus which reliably prepares the strand or yarn ends of yarn packages supported in upright dispositions on individual package support members in which the strand or yarn end preparation apparatus optimally applies suction force to the yarn package and which performs the strand end preparation process without the need to axially shift the yarn package.

SUMMARY OF THE INVENTION

The present invention provides a strand end preparation apparatus which provides several improvements over known yarn or strand end preparation devices. The strand end preparation apparatus of the present invention beneficially reduces the risk that a strand end rewound onto a package of textile material will slough off the textile package by providing a means for engaging an unwound strand end to apply yieldable resistance thereto in opposition to rewinding of the strand end onto the textile package.

Additionally, the strand end preparation apparatus of the present invention optimizes the application of suction to a package of textile material for the unwinding of the strand end therefrom by providing a conduit having an opening and means for reducing the effective transverse cross-sectional area of the conduit. The conduit is disposed for applying suction from a suction source through the opening to engage the strand end of the textile package and the cross-sectional area reducing means reduces the effective transverse cross-sectional area of the conduit progressively in an upstream direction adjacent the opening to control the suction applied through the opening to predetermined values therealong.

The strand end preparation apparatus of the present invention also beneficially provides the capability to selectively vary the length of a strand end unwound from a package of textile material so that a preferred number of windings can be created upon rewinding of the strand end onto the textile package. The strand end preparation apparatus which provides this improvement includes a conduit and a removable extension means for selectively varying the effective length of the conduit between a cutting location at which an unwound strand end is cut and an opening through which suction is applied to the textile package.

The strand end preparation apparatus of the present invention further includes an improved capability for guiding an unwound strand end onto a predetermined axial location on a package of textile material during rewinding of the strand end thereon. The strand end preparation apparatus provides a conduit having an opening for applying suction therethrough to engage the end of the textile strand material and unwind the strand end from the package. Additionally, rewinding guide means are provided which is selectively positionable along the conduit opening for adjusting the relative position along the conduit opening at which the unwound strand end exits the conduit during rewinding onto the package. This feature permits rewinding of an unwound strand end at a predetermined axial location on the package during rewinding. The rewinding guide means is configured to advantageously cover a portion of the conduit opening during unwinding of the strand end so that the application of suction to the textile package is optimized.

According to one aspect of the present invention, there is provided a strand manipulating device in an apparatus for partially unwinding an end of a strand of textile material from a package and subsequently rewinding the unwound end in a preferred disposition on the package. The strand manipulating device includes means for supporting the end of the textile strand material during unwinding and means for engaging the unwound strand end to apply yieldable resistance thereto in opposition to rewinding thereof onto the textile package.

The one aspect of the strand manipulating device preferably includes sensing means for sensing the presence of the unwound strand end while the unwound strand end is supported by the supporting means. The engaging means is operatively connected to the sensing means for engaging the unwound strand end in response to sensing thereof by the sensing means at a sensing location downstream of the engaged portion of the unwound strand end relative to the direction of travel of the textile strand material during its unwinding.

In the one aspect of the strand manipulating device, the supporting means preferably includes a conduit operatively connected to a suction source and having an opening, and the conduit being disposed for applying suction through the conduit opening to the package to engage an end of the strand of textile material on the package and subsequently move the engaged end along the conduit to effect unwinding of the strand end. Also, the sensing means is operatively connected to the conduit for sensing the unwound strand end supported therein and the engaging means is operatively connected to the conduit for engaging the unwound strand end supported in the conduit.

According to another feature of the one aspect of the strand manipulating device, there is provided means for cutting a strand end disposed in the conduit at a cutting location intermediate the conduit opening and the suction source, the cutting means having a pair of cutting jaws movable relative to one another between a disengaged position out of engagement with the strand end and an engaged position in which the cutting jaws cut the strand end. The cutting means preferably includes a suction blocking profile for substantially completely blocking the flow of suction past the cutting location in the engaged position of the cutting jaws.

According to an additional feature of the one aspect of the strand manipulating device, the conduit includes a removable extension means for selectively varying the effective length of the conduit between the cutting location and the conduit opening, the removable extension means being mountable in the conduit intermediate the conduit opening and the cutting means.

According to another aspect of the present invention, an improvement is provided in an apparatus for partially unwinding an end of a strand of textile material from a package and subsequently rewinding the unwound end onto the package. The improvement includes a conduit having an opening and operatively connected to a suction source. The conduit is disposed for applying suction from the suction source through the opening to engage the strand end and draw the strand end along the conduit to effect unwinding of the strand end from the package, and has means for reducing its effective transverse cross-sectional area progressively in an upstream direction adjacent the opening to control the suction applied through the opening to predetermined values therealong.

According to a further aspect of the present invention, an improvement is provided in an apparatus for partially unwinding an end of a strand of textile material from a package and subsequently rewinding the unwound end onto the package at a predetermined location thereon relative to the axis of the package. The improvement includes a conduit having an opening for applying suction therethrough to engage the end of the textile strand material and unwind the strand end from the package, the conduit supporting the unwound strand end therein during unwinding of the strand end from the package and during rewinding of the unwound strand onto the package, the unwound strand end traveling through the conduit opening during the rewinding thereof onto the package. Also, the improvement includes rewinding guide means, selectively positionable along the conduit opening, for adjusting the relative position along the conduit opening at which the unwound strand end exits the conduit during rewinding of the unwound strand end onto the package to thereby vary the predetermined axial location on the package onto which the strand end is rewound.

The conduit opening preferably has an axial extent for applying suction along the axial extent of the package and the rewinding guide means includes opening covering means for covering a predetermined axial extent of the conduit opening to effect adjustment of the axial extent of suction applied to the package through the conduit opening.

In an apparatus for partially unwinding an end of a strand of textile material, wherein the textile material of the package is built on a tube and the package is individually supported on a package support member having a peg inserted into one end of the tube, the rewinding guide means preferably includes a projecting member projecting outwardly relative to the conduit opening for applying a moment force to the tube relative to the tube end inserted on the peg to thereby enhance the frictional engagement of the tube and the package support member, whereby the transmission of rotational movement of the package support member to the package is enhanced.

According to one feature of the another aspect of the present invention, the conduit includes a tubular portion having an axis and having a substantially uniform cross-sectional area transversely to its axis, the conduit opening being located at the tubular portion and the means for reducing the effective transverse cross-sectional area of the conduit includes a plate member disposed in the tubular portion and extending at an angle relative to the tubular portion axis.

According to the one aspect of the present invention of the strand manipulating device, the engaging means includes a pair of jaws movable relative to one another to compressively engage the unwound strand end therebetween, at least one of the jaws being resiliently mounted to the supporting means for resiliently deflecting relative to the other of the jaws to effect application of a yieldable resistance to the unwound strand end in opposition to rewinding thereof onto the textile package. Also, the engaging means preferably includes a suction blocking profile for substantially completely blocking the flow of suction past the engaging means when the jaws are disposed for compressively engaging the unwound strand end therebetween.

BRIEF DESCRIPTION OF THE DRAWING

The sole Figure of the drawing is a perspective view of a portion of a yarn package transport assembly and the preferred embodiment of the strand end preparation apparatus of the present invention in operational position relative to the yarn package transport assembly for preparing the strand end of a yarn package transported on the yarn package transport assembly.

DETAILED DESCRIPTION OF THE PREFERRED EMBODIMENT

In the drawing, the preferred embodiment of the strand end preparation device of the present invention is illustrated. A yarn package transport assembly 1 transports a plurality of yarn packages 5, each individually supported on a conventional package support member 4, to a location for handling the yarn or textile material built on each yarn package 5. For example, the yarn transport assembly 1 may transport the supported yarn packages 5 to a conventional winding machine (not shown) for unwinding of the yarn of each yarn package 5 thereat. The strand end preparation device is particularly suitable for preparing yarn packages which are subsequently handled by devices of the type which direct tangential streams of air against the yarn package to effect further dislodgement of the strand end at the winding machines.

The yarn package transport assembly 1 includes an endless member or belt 2 supported by a pair of guide channels 3,3'. Each guide channel 3,3' is formed with a lower support surface for supporting the belt 2 thereon and an upper guide surface extending parallel to its lower support surface at a spacing therefrom sufficient to permit passage therebetween of the belt 2 and an annular base portion of a package support member 4 supported on the belt 2. Each upper guide surface of the guide channels 3,3' includes an inner edge and the pair of inner edges extend in parallel, spaced relation to one another for the passage therebetween of a neck portion of the package support members 4 to effect guiding of the package support members 4.

The strand end preparation apparatus includes a package rotation component for rotating a yarn package 5 about its axis during the unwinding of a strand end therefrom and the rewinding of a strand end onto the yarn package. The package rotation component includes a press roller 14 rotatably mounted to one free end of a pivot arm 15. A pivot shaft 16 is fixedly mounted to the other free end of the pivot arm 15 and the pivot shaft 16 is operatively interconnected to a conventional pivot drive device (not shown) for pivoting movement of the pivot arm 15 about the axis of the pivot shaft 16. The pivot drive mechanism can be, for example, in the form of a conventional cam-type drive mechanism or a conventional solenoid mechanism.

The guide channel 3' is formed with an opening 6 to permit the press roller 14 to be pivoted into direct engagement with the annular base portion of the respective package support member 4 positioned at the strand end preparation location. The press roller 14 is freely rotatable about its axis and its circumferential surface is generally axially aligned with the circumferential surface of the annular base portion of the respective package support member 4 for rolling engagement therealong.

The package rotation component additionally includes a pair of rotation rollers 19 (one being shown in solid lines and the other in broken lines) mounted to a pivot plate 21. The pivot plate 21 has four sides with the pair of the rotation rollers 19 being mounted on a common side thereof. A pivot shaft 22 is fixedly mounted to the pivot plate 21 adjacent a corner remote from the rotation rollers 19 and a drive roller 17 is pivotally mounted to the pivot plate 21 at another corner of the pivot plate 21.

The drive roller 17 is operatively connected to the drive shaft of a conventional drive motor 18 for driving rotation of the drive roller 17. An endless member or drive belt 20 which can be in the form, for example, of a conventional elastomeric belt, is trained around the drive roller 17 and the rotation rollers 19 for driving movement in correspondence with the driving rotation of the drive roller 17 by the drive motor 18.

The guide channel 3 is provided with an opening 6' for permitting direct engagement of the drive belt 20 with the circumferential surface of the annular base portion of the respective package support member 4 at the strand end preparation location. The pivot shaft 22 is operatively interconnected to the conventional pivot drive mechanism to which the pivot shaft 16 is interconnected for pivoting movement of the pivot plate 21 about the axis of the pivot shaft 22 between a disengaged position in which the drive belt 20 is disposed out of interference with the package support members 4 being transported by the yarn package transport assembly 1 and an engaged position in which the drive belt 20 is in engagement with the respective package support member 4 at the strand end preparation location.

The drive motor 18 is operatively connected via a connector 18' to a control unit 23.

The strand end preparation apparatus includes a strand manipulating device for engaging an end of a strand of textile material on a yarn package 5 supported at the strand end preparation location The strand manipulating device includes a means for supporting the end of the textile strand material during unwinding which can be, for example, in the form of a conduit 8 which is operatively connected to a conventional suction source (not shown). The conduit 8 is in the form of a cylindrical tube having a uniform transverse cross-section and includes a tubular portion having an opening 9 formed therein for applying suction created by the suction source to a yarn package 5 supported at the strand end preparation location.

The opening 9 is in the form of a longitudinal slot aligned with the axis of the tubular portion and the tubular portion is supported such that its axis is generally parallel with the axis of a yarn package 5 supported at the strand end preparation location. The longitudinal extent of the opening 9 generally corresponds to the axial length of the tube of a yarn package 5 such that the upper end of the opening 9 extends axially beyond the upper end of the tube and the lower end of the opening 9 extends at least to the lower windings of the yarn package 5.

The strand manipulating device includes means for engaging a strand end 7 unwound from a yarn package 5 to apply a yieldable resistance to the unwound strand end in opposition to rewinding thereof onto the yarn package 5. The unwound strand end engaging means is preferably in the form of a strand brake 25 having a lower jaw 27 and an upper jaw 28, both mounted in a sealed housing in communication with the conduit 8 and transversely with respect thereto. The lower jaw 27 extends interiorly of the conduit 8 at an angle to the direction of travel of an unwound strand end 7 drawn into the conduit 8 during unwinding of the strand end from a yarn package 5 supported at the strand end preparation location. One end of the lower jaw 27 is supported on a coil spring 26 and the other end of the lower jaw 27 is freely pivotally mounted to a jaw pivot shaft 30 such that the lower jaw 27 freely pivots about the jaw pivot shaft 30 with the spring 26 resiliently opposing pivotal movement of the lower jaw 27. One end of the upper jaw 28 is fixedly mounted to the jaw pivot shaft 30.

One end of the jaw pivot shaft 30 extends outwardly of the housing in which the jaws 27,28 are disposed and its outwardly extending end is fixedly mounted to one end of a pivot drive arm 31. The other end of the pivot drive arm 31 is pivotally connected to the free end of a piston 32 of a pneumatic cylinder and piston assembly 33. A conventional sealing means (not shown) seals the strand brake housing at the location at which the jaw pivot shaft 30 extends outwardly of the housing to prevent loss of suction in the conduit 8.

The pneumatic cylinder and piston assembly 33 includes an air inlet member 34 and an air outlet member 35 for, respectively, introducing pneumatic fluid into the cylinder from a conventional pneumatic fluid source (not shown) and for outletting pneumatic fluid from the cylinder to effect selective extension and retraction of the piston 32 relative to the cylinder. The retraction of the piston 32 into the cylinder of the cylinder and piston assembly 33 effects pivoting of the pivot arm 31 relative to the piston 32 and corresponding rotation of the jaw pivot shaft 30 about its axis. The rotation of the jaw pivot shaft 30 effects pivoting of the upper jaw 28 toward the lower jaw 27 to effect compressive engagement of an unwound strand end 7 disposed on the lower jaw 27 against the resistance of the spring 26. The extension of the piston 32 from the cylinder of the cylinder and piston assembly 33 effects rotation of the jaw pivot shaft 30 about its axis and corresponding pivoting of the upper jaw 28 in a direction away from the lower jaw 27 to thereby open the jaws 27,28.

The strand brake 25 additionally includes a suction blocking profile 29 mounted to the upper jaw 28. The suction blocking profile 29 is compatibly configured with the transverse cross-section of the conduit 8 at the strand braking location to substantially prevent the passage of air therepast when the jaws 27,28 are disposed in their strand engaging disposition. Due to the air blocking action of the suction blocking profile 29, substantially no suction is applied through the opening 9 when the jaws 27,28 compressively engage an unwound strand end 7.

The pneumatic cylinder and piston assembly 33 is operatively connected via a conventional connector (not shown) to the control unit 23.

The strand end preparation apparatus also includes a sensing means for sensing the presence of an unwound strand end 7 at a sensing location. The sensing means is in the form of a light source 36 for emitting light and a photodiode 37. The light source 36 is mounted to the conduit 8 for emitting a beam of light at an angle relative to the direction of unwinding travel of a strand end 7 in the conduit 8. The photodiode 37 is operatively connected via a connector 37' to the control unit 23 and is mounted to the conduit 8 at a location for sensing the light beam emitted by the light source 36 and transmitting a signal via the connector 37' to the control unit 23 in response to an interruption in the light beam caused by the travel therethrough of an unwound strand end 7. The sensing location is located downstream of the strand end engaging location at which the strand brake 25 engages an unwound strand end 7 relative to the direction of unwinding travel of the unwound strand end 7 in the conduit 8.

The strand end preparation apparatus also includes a strand cutting means for cutting a strand end supported in the conduit 8 at a cutting location intermediate the opening 9 and the suction source. The cutting means is in the form of a cutter 39 having a fixed cutting jaw 47 and a movable cutting jaw 41 movable relative to the fixed cutting jaw 47 between a disengaged position out of engagement with an unwound strand end 7 supported in the conduit 8 and an engaged position in which the cutting jaws cut the unwound strand end. The movable cutting jaw 41 is fixedly mounted to a pivot shaft 40 which is freely rotatably supported by a housing 38. The housing 38 is mounted to the conduit 8 in sealed communication therewith. One end of the pivot shaft 40 extends outwardly of the housing 38 and is fixedly mounted to one end of a pivot arm 49. The other end of the pivot arm 49 is pivotally connected to the free end portion 42 of a piston 43 of a pneumatic cylinder and piston assembly 44. The pneumatic cylinder and piston assembly 44 includes an inlet member 46 and an outlet member 45 for controlling the flow of pneumatic fluid in the cylinder to thereby effect extension and retraction of the piston 43. The inlet member 46 is operatively connected to a conventional pneumatic fluid source (not shown) which is operatively connected to the control unit 23.

Each of the cutting jaws 41,47 is formed with a semi-cylindrical profile generally corresponding to the transverse cross-section of the conduit 8 at the strand cutting location. The semi-cylindrical profiles of the cutting jaws 41,47 substantially completely block the conduit 8 when the cutting jaw 41 is in its strand engaging position to thereby restrict the flow of air therepast. The restriction of the flow of air past the strand cutting location substantially stops the suction applied through the opening 9.

According to an additional feature of the strand end preparation apparatus, an extension member 50 is provided to extend the effective length of the conduit 8 between the opening 9 and the strand end cutting location. The extension member 50 is in the form of a linear cylindrical tube having the same diametrical cross-section as the conduit 8. The extension member 50 can be disposed between two portions of the conduit 8 at an appropriate location intermediate the opening 9 and the strand end cutting location such as, for example, at a location intermediate the strand brake 25 and the sensing means. The extension member 50 can be mounted to the conduit 8 in sealed disposition therewith by conventional mounting means such as, for example, through a pressfit between the ends of the extension member 50 and the conduit 8.

According to another additional feature of the strand end preparation apparatus, a rewinding guide means is provided for adjusting the relative position along the opening 9 at which a strand end 7 enters and exits the conduit 8 and particularly for locating the strand during rewinding of the unwound strand end onto the package. The rewinding guide means includes a slide plate 11 and a pair of slide plate guiding means in the form of spaced bars 12 for guiding movement of the slide plate 11. The bars 12 are secured to the exterior of the suction conduit 8 and extend parallel to the opening 9 in bracketing relation thereto adjacent the upper end of the opening. The slide plate 11 is formed with a curvature corresponding to the curvature of the outer surface of the conduit 8 and is slidably retained by the bars 12, which permit sliding movement of the slide plate 11 relative to the opening 9 to selected positions in which the slide plate 11 is in superposed opening closing relation with the upper end of the opening 9. As the slide plate 11 is moved in the direction from the upper end of the opening 9 towards its lower end, the slide plate 11 covers an increasing extent of the opening 9 adjacent its upper end to prevent the flow of suction air therethrough. The slide plate 11 is retained by the bars 12 such that the slide plate remains substantially stationary in each position to which it is moved.

The strand end preparation device includes, in a further feature thereof, means for reducing the effective transverse cross-section of the conduit 8 progressively in an upstream direction adjacent said opening to thereby control the suction force applied through the opening to predetermined values along the extent of the opening. The cross-section reducing means is in the form of a plate member 13 disposed in the tubular portion of the conduit 8 in which the opening 9 is formed. The plate member 13 has a base having an extent corresponding to a chord of the transverse cross-section of the tubular portion of the conduit 8 and the side opposite the base of the plate member 13 has an extent less than the base of the plate member. The plate member 13 tapers from its base along an extent of a length generally corresponding to the longitudinal extent of the opening 9. The tubular portion of the conduit 8 forms the end of the conduit and includes a removable closure disk 10. The closure disk 10 is removable to permit disposition of the plate member 13 in the tubular portion of the conduit 8 and removal of the plate member 13 therefrom.

The operation of the strand end preparation apparatus is as follows. The control unit 23, which is operatively connected to the conventional pivot drive means for driving the pivot shafts 16,22 of the package rotation component, controls the pivot drive means to maintain the press roller 14 and the rotation rollers 19 in their normally disengaged positions. As each package support member 4 is transported by the belt 2 in the direction shown by the arrow in the drawings, a conventional sensor (not shown) disposed upstream of the strand end preparation location senses the travel therepast of each respective package support member 4 and transmits this information to the control unit 23. The control unit 23 controls the pivot drive mechanism in response to the receipt of a signal from the package support member sensor to effect pivoting of the press roller 14 and the rotation rollers 19 to their respective package support member engaging positions in correspondence with the arrival of the sensed package support member 4 at the strand end preparation location.

The press roller 14 is moved by the pivoting action of the pivot arm 15 into the opening 6 to engage the respective package support member 4 while the rotation rollers 19 are moved into the opening 6' by the pivoting of the pivot plate 21 to engage the respective package support member 4 at two other circumferentially spaced locations thereon. The three circumferentially spaced locations at which the press roller 14 and the rotation rollers 19 engage the respective package support member 4 define a triangle and this three-point manner of engagement acts to retain the engaged package support member 4 at a location adjacent the suction conduit 8 at which the opening 9 of the conduit 8 can apply a suction to the yarn package 5 supported on the package support member 4.

Following the engagement of the respective package support member by the press roller 14 and the rotation rollers 19, the control unit 23 controls the drive motor 18 via the connector 18' to effect driving of the drive belt 20. The control unit 23 can be configured, for example, to respond from a signal from the pivot drive mechanism indicating that the press roller 14 and the rotation rollers 19 have been pivoted to their engaged positions or, alternatively, the control unit 23 can be configured to actuate the driving of the drive belt 20 after the lapse of a predetermined period of time following the receipt of a signal from the package support member sensor. As the belt 20 moves between the rotation rollers 19 in the direction shown by the arrow in the drawing, the drive belt 20 engages the circumferential surface of the annular base portion of the package support member and effects corresponding rotation of the package support member while the package support member continues to be maintained at the strand end preparation location by the action of the press roller 14 and the rotation rollers 19.

The yarn package 5 rotates in correspondence with the rotation of the package support member 4 and the degree to which the rotation of the package support member 4 is transmitted to the yarn package 5 is depends, in part, upon the frictional disposition of the yarn package 5 on the upright peg of the package support member 4. In general, if the yarn package fits loosely on the upright peg, correspondingly less rotation movement of the package support member 4 is transmitted to the yarn package than if the yarn package 5 is tightly fitted onto the upright peg of the package support member. To enhance the transmission of the rotation movement of the package support member 4 to the yarn package 5, the press roller 14 and the rotation rollers 19 are each provided with a radially extending flange. The flange on the press roller 14 is formed on the top surface thereof and is adapted to engage the top surface of the annular base portion of the package support member 4. The flanges of the rotation rollers 19 are formed on the bottom surfaces thereof and are adapted to engage the bottom surface of the annular base portion of the package support member 4. The flanges of the rotation rollers 19 slightly lift the package support member 4 from the belt 2 while the flange of the press roller 14 opposes lifting of the package support member 4 from the belt 2. The flanges of the press roller 14 and the rotation rollers 19 thus prevent tilting of the package support member 4.

A tube engaging projection 48 is formed on the slide plate 11 facing and projecting into engagement against the exposed end 5' of the yarn package 5 to apply a moment force to the yarn package 5 in opposition to the resistance to tilting of the rollers 14,19, thereby enhancing the frictional engagement between the upright peg and the lower inner surface of the tube of the yarn package 5.

The control unit 23 controls rotation of the yarn package 5 in correspondence with the application of suction through the opening 9 to the yarn package 5. In this regard, the progressively reduced effective cross-sectional area of the conduit 8 at the opening 9 resulting from the disposition of the plate member 13 controls the magnitude of the suction applied along the opening 9 to a substantially uniform value. The suction draws the strand end 7 on the yarn package 5 into the conduit 8 through the opening 9 under the slide plate 11 for travel along the conduit 8 in the direction toward the suction source. The rotation of the yarn package 5 causes the unwinding of the strand end 7 during this movement of the strand end in the conduit 8. As the unwound strand end 7 travels through the light beam emitted by the light source 36, the photodiode 37 senses the interruption of the light beam 36 and transmits a signal via the connector 37' to the control unit 23. In response to the signal from the photodiode 37, the control unit 23 controls the connection of the pneumatic fluid source to the cylinder and piston assembly 33 of the strand braking means and the cylinder and piston assembly 44 of the strand cutting means to activate these elements. In this manner, pneumatic fluid is introduced through the inlet member 35 to effect retraction of the piston 32 into the cylinder of the cylinder and piston assembly 33. The retraction of the piston 32 causes rotation of the jaw pivot shaft 30 about its axis and corresponding pivoting of the upper jaw 28 against the lower jaw 27 to compressively engage the unwound strand end 7 therebetween and to close the conduit 8 with the profile 29 on the upper jaw 28. Pneumatic fluid is similarly introduced to the inlet member 46 to effect extension of the piston 43 from the cylinder of the pneumatic cylinder and piston assembly 44 to effect pivoting of the movable cutting jaw 41 via pivoting of the pivot shaft 40 through the pivot arm 49. The movable cutting jaw 41 is pivoted against the stationary cutting jaw 47 to cut the unwound strand end 7 disposed therebetween. The cut portion of the unwound strand end 7 is drawn further along the conduit 8 due to the suction created by the suction source. The remainder of the unwound strand end 7, however, is no longer subjected to the suction action of the suction source because the suction blocking profile of the pivotable cutting jaw 41 and the suction blocking profiles of the stationary cutting jaw 47 effectively prevent passage of air therepast.

In correspondence with the cutting of the unwound strand end 7, the control unit 23 controls the drive motor 18 to drive the drive belt 20 in an opposite direction to effect rotation of the package support member 4 and corresponding rotation of the yarn package 5 in a winding direction. As the yarn package 5 is rotated in a winding direction, the unwound strand end 7 is rewound onto the yarn package. During this rewinding operation, the travel of the now-cut, unwound strand end 7 is yieldably resisted through the compressive actions of the jaws 27,28 under the resilient bias of the spring 26 to permit passage of the unwound strand end 7 between the jaws 27,28. The yieldable resistance of the jaws 27,28 acts to increase the tension of the unwound strand end being rewound on the yarn package 5 to thereby minimize the risk that a slack extent of the strand end will be disposed in the yarn package which may tend to slough off the yarn package during subsequent handling before engagement at the winding station.

The slide plate 11 controls the relative position along the opening 9 at which the unwound strand end 7 exits the conduit 8 on its travel toward the yarn package 5. In this manner, the longitudinal extent of the opening 9 can be adjusted in relation to the axial extent of the respective yarn package being handled by the strand end preparation apparatus. Preferably, the positioning of the slide plate 11 is such that the tube engaging projection 48 is in alignment with the exposed end portion 5' of the tube of the respective yarn package for the purpose described above.

The slide plate 11 closes the portion of the opening 9 which it overlies so that the suction action is appropriately concentrated on the respective yarn package at the strand end preparation location.

Once the unwound strand end 7 has been completely rewound onto the yarn package 5, the control unit 23 controls the drive motor 18 to cease rotation of the package support member 4 and controls the pneumatic fluid connections to return the strand brake 25 and the yarn cutting means 39 to their respective disengaged positions. Additionally, the control unit 23 controls the pivot drive mechanism to effect movement of the press roller 14 and the rotation rollers 19 out of engagement with the respective package support member 4 at the strand end preparation location. The yarn package transport assembly 1 then transports the package support member 4 to the further handling location with the strand end of the yarn package 5 positioned in a preferred disposition for ready engagement, for example, at a winding station.

The extension member 50 can be installed on the conduit 8 to vary the effective distance from the opening 9 to the strand end cutting location source. For example, if it is desired that the unwound strand end 7 be relatively lengthened so that additional windings of the strand end are created when the strand end is rewound on the yarn package, an operator can install the extension member 50 to thereby extend the effective distance between the opening 9 and the yarn cutting means 39. Additionally, the extension member 50 can be installed if it is desired to maintain the number of windings of the strand end at a generally uniform value such as, for example, three to four windings, during strand end preparation operations on tubes of differing diameters. In connection with the use of the extension member 50, factors such as the thickness of the strand and the fineness of the strand must be considered in determining the appropriate number of windings to place on a yarn package. The use of an extension member 50 also provides the capability of positioning the conduit 8 with the tube end engaging projection 48 in proper engagement with the tube end 5.

The present invention contemplates that the magnitude of the suction force applied along the opening 9 can be varied by appropriate replacement of the plate member 13 with other tapered plate members of varying dimensions or by eliminating the use of any plate member. In this regard, the removable closure disk 10 permits ready removal and insertion of the tapering plate members.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In an apparatus for partially unwinding an end of a strand of textile material from a package and subsequently rewinding the unwound end in a preferred disposition on the package, the package being formed of a body of textile strand material wound on a tube, the tube having an axis and a top and bottom portion, and the top portion of the tube extending axially beyond the body of textile strand material in an exposed condition, a strand manipulating device, comprising:

means for supporting a package in a strand end preparation disposition during unwinding of a strand end therefrom;

means for supporting an unwound strand end during unwinding of the strand end from the package, the supporting means including a suction conduit, means forming a slot at one end of the suction conduit and means for applying suction through the slot to the package to effect drawing of the strand end into the suction conduit, the means forming a slot including means forming an upper end of the slot generally at the same axial level as the exposed top portion of the tube of the package relative to the tube axis and the suction conduit extending from the upper end of the slot axially beyond the upper end of the slot in the direction from the bottom portion of the tube toward the top portion of the tube such that the upper end of the slot guides the strand end in a change of direction from a first direction in which the strand end travels from the package to the upper end of the slot to a second direction different from the first direction in which the strand end travels from the upper end of the slot along the suction conduit;

means for engaging the unwound strand end supported in the suction conduit at a resistance location upstream of the upper end of the slot relative to the direction of travel of the strand end during rewinding thereof, the engaging means applying yieldable resistance to the portion of the strand end extending between the upper end of the slot and the engaging means; and sensing means for sensing the presence of the unwound strand end while the unwound strand end is supported in the suction conduit, said engaging means being operatively connected to said sensing means for engaging the unwound strand end at the resistance location in response to sensing of the strand end by the sensing means.

2. In an apparatus for partially unwinding an end of a strand of textile material, the strand manipulating device according to claim 1 and characterized further by means for cutting a strand end disposed in said conduit at a cutting location intermediate said conduit opening and the suction source, said cutting means having a pair of cutting jaws movable relative to one another between a disengaged position out of engagement with the strand end and an engaged position in which said cutting jaws cut the strand end.

3. In an apparatus for partially unwinding an end of a strand of textile material, the strand manipulating device according to claim 2 and characterized further in that said cutting means includes a suction blocking profile for substantially completely blocking the flow of suction past said cutting location in said engaged position of said cutting jaws.

4. In an apparatus for partially unwinding an end of a strand of textile material, the strand manipulating device according to claim 2 and characterized further in that said conduit includes a removable extension means for selectively varying the effective length of said conduit between said cutting location and said conduit opening, said removable extension means being mountable in said conduit intermediate said conduit opening and said cutting means.

5. In an apparatus for partially unwinding an end of a strand of textile material from a package and subsequently rewinding the unwound end onto the package, the improvement comprising:

a conduit having an opening and operatively connected to a suction source, said conduit disposed for applying suction from the suction source through said opening to engage the strand end and draw the strand end along said conduit to effect unwinding of the strand end from the package, and said conduit having means for reducing its effective transverse cross-sectional area progressively in an upstream direction adjacent said opening to control the suction applied through said opening to predetermined values therealong.

6. In an apparatus for partially unwinding an end of a strand of textile material from a package and subsequently rewinding the unwound end onto the package at a predetermined location thereon relative to the axis of the package, the improvement comprising:

a conduit having an opening for applying suction therethrough to engage the end of the textile strand material and unwind the strand end from the package, said conduit supporting the unwound strand end therein during unwinding of the strand end from the package and during rewinding of the unwound strand onto the package, the unwound strand end traveling through said conduit opening during the rewinding thereof onto the package; and rewinding guide means, selectively positionable along said conduit opening, for adjusting the relative position along said conduit opening at which the unwound strand end exits said conduit during rewinding of the unwound strand end onto the package to thereby vary the predetermined axial location on the package onto which the strand end is rewound.

7. In an apparatus for partially unwinding an end of a strand of textile material, the improvement according to claim 6 and characterized further in that said conduit opening has an axial extent for applying suction along the axial extent of the package and said rewinding guide means includes opening covering means for covering a predetermined axial extent of said conduit opening to effect adjustment of the axial extent of suction applied to the package through said conduit opening.

8. In an apparatus for partially unwinding an end of a strand of textile material, the improvement according to claim 6 wherein the textile material of the package is built on a tube and the package is individually supported on a package support member having a peg inserted into one end of the tube and characterized further in that said rewinding guide means includes a projecting member projecting outwardly relative to said conduit opening for applying a moment force to the tube relative to the tube end inserted on the peg to thereby enhance the frictional engagement of the tube and the package support member, whereby the transmission of rotational movement of the package support member to the package is enhanced.

9. In an apparatus for partially unwinding an end of a strand of textile material, the improvement according to claim 6 and characterized further in that said conduit includes a tubular portion having an axis and having a substantially uniform cross-sectional area transversely to its axis, said conduit opening being located at said tubular portion, and means for reducing the effective transverse cross-sectional area of said conduit including a plate member disposed in said tubular portion and extending at an angle relative to said tubular portion axis.

10. In an apparatus for partially unwinding an end of a strand of textile material from a package and subsequently rewinding the unwound end in a preferred disposition on the package, a strand manipulating device, comprising:

means for supporting the end of the textile strand material during unwinding; and a first jaw mounted to the supporting means;

a second jaw;

means for movably mounting the second jaw to the supporting means for movement of the second jaw between a gripping position in which the first and second jaws apply a compressive force to the unwound strand end during rewinding thereof onto the textile package and a non-gripping position in which the first and second jaws are spaced from one another sufficient to permit the movement of the unwound strand end therebetween without compressive resistance by the first and second jaws, the movably mounting means including means for biasing the second jaw toward its gripping position, the biasing means permitting resilient deflection of the second jaw from its gripping position during the passage therepast the unwound strand end, whereby the first and second jaws apply a yieldable resistance to the unwound strand end in opposition to rewinding thereof onto the textile package.

11. In an apparatus for partially unwinding an end of a strand of textile material, the strand manipulating device according to claim 10 wherein the supporting means includes a suction conduit through which suction is applied to the end of the textile strand material during unwinding and characterized further by an engaging means having a suction blocking profile positionable in the suction conduit for substantially completely blocking the flow of suction therepast when said jaws are disposed for compressively engaging the unwound strand and therebetween.

* * * * *